United States Patent [19]

Kingsbury

[11] 4,439,062

[45] Mar. 27, 1984

[54] SEALING SYSTEM AND METHOD FOR SEALING EARTHEN CONTAINERS

[75] Inventor: Robert P. Kingsbury, Laconia, N.H.

[73] Assignee: American Colloid Co., Skokie, Ill.

[21] Appl. No.: 332,351

[22] Filed: Dec. 21, 1981

[51] Int. Cl.[3] ..... E02B 3/04

[52] U.S. Cl. ..... 405/24; 405/28; 405/35

[58] Field of Search ..... 405/270, 52–59, 405/128, 129, 258, 263

[56] References Cited

U.S. PATENT DOCUMENTS

| | | | |
|---|---|---|---|
| 3,383,863 | 5/1968 | Berry | 405/270 |
| 3,505,820 | 4/1970 | Draper et al. | 405/53 |
| 3,925,992 | 12/1975 | Backstrom | 405/53 |
| 4,279,547 | 7/1981 | Clem | 405/270 X |
| 4,335,978 | 6/1982 | Mutch | 405/129 |
| 4,345,581 | 8/1982 | Sbacher | 405/53 X |
| 4,352,601 | 10/1982 | Valiga et al. | 405/270 |

*Primary Examiner*—Dennis L. Taylor
*Attorney, Agent, or Firm*—Mason, Kolehmainen, Rathburn & Wyss

[57] ABSTRACT

A sealing system for an earthen container such as a pit, lagoon, land fill or the like for storing waste materials includes an outer seal layer formed by mixing a water expandable colloidal clay, such as bentonite with the soil of the pit. A middle or intermediate layer is defined by a layer of granular fill material placed on the first layer. An inner seal layer is formed by mixing water expandable colloidal clay, such as bentonite with the upper surface of the granular fill layer. A source of pressurized clean fluid is in communication with the granular fill layer to develop pressure therein and prevent leakage through the inner seal layer. Level sensing apparatus for sensing the level of waste and clean fluids may be included and apparatus for detecting leakage may also be included.

15 Claims, 3 Drawing Figures

SEALING SYSTEM AND METHOD FOR SEALING EARTHEN CONTAINERS

BACKGROUND OF THE INVENTION

A. Field of the Invention

The present invention relates to a sealing system and in particular to a new and improved system for preventing leakage of waste fluids from an earthen container into ground water.

B. Description of the Prior Art

Chemical wastes and other fluids are often stored in earthen lagoons. The hydrostatic pressure resulting from the body of fluid in the lagoon results in pressure that may cause leakage of the waste material into the ground water. In the prior art there have been attempts to prevent this leakage or seepage of waste material into the ground water and examples of prior art approaches are provided in U.S. Pat. Nos. 4,068,480 and 4,194,855. These prior art systems typically employ an impervious liner that is often subject to deterioration, rupture and leakage due to piercing or cuts.

Another system for sealing lagoons containing waste material is to provide a first layer formed by mixing water absorbant material with the soil of the pit. A second layer is provided by a layer of granular fill material and a third layer is provided by water absorbant material being mixed with the upper surface of the granular fill material. This sealing system, however, suffers deterioration due to the driving force developed by the hydrostatic pressure of the waste fluid in the lagoon. This force is proportional to the depth of the waste fluid and will eventually permeate the seals. The time required for flow through the seal will vary with the amount or head of the fluid in the lagoon, the thickness of the seal and the coefficient of permeability of the seals.

SUMMARY OF THE PRESENT INVENTION

An object of the present invention is to provide a new and improved sealing system for earthen lagoons used for storing waste fluids.

Another object of the present invention is to provide a new and improved method for sealing an earthen lagoon.

Another object of the present invention is to provide a new and improved sealing system that is relatively inexpensive and efficient.

Another object of the present invention is to provide a new and improved sealing system for landfills used to store solid wastes so that hazardous liquids, resulting from a portion of the solid waste being dissolved by precipitation, are prevented from entering ground water.

A further object of the present invention is to provide a new and improved sealing system for an earthen lagoon to store waste materials wherein leakage in an inner, waste water-contacting seal can be easily detected.

The present invention is directed to a new and improved sealing system for an earthen lagoon or a landfill for storing liquid waste materials and the like. The sealing system includes a first layer formed by disposing a layer comprising a water expandable colloidal clay, such as bentonite, on the soil of the earth. A second layer is formed by disposing granular fill material on the first layer. The sealing system includes a third or inner seal layer comprising a water expandable colloidal clay disposed on an upper surface of the granular fill layer. The granular fill layer then is flooded with a fluid under pressure preferably water, at a level above the level of the waste fluid. The system may also include apparatus for extracting fluid from the granular fill layer for determination of whether a leak has occurred in the inner seal. Level sensors may also be included to sense the relative level of the waste fluid in comparison with the fluid flooding the granular fill layer to insure that pressure above the pressure of the waste fluid is maintained in the granular fill layer.

BRIEF DESCRIPTION OF THE DRAWING

The above and other objects and advantages and novel features of the present invention will become apparent from the following detailed description of the preferred embodiment of the invention illustrated in the accompanying drawing wherein.

BRIEF DESCRIPTION OF THE PREFERRED EMBODIMENT

Figure 1:
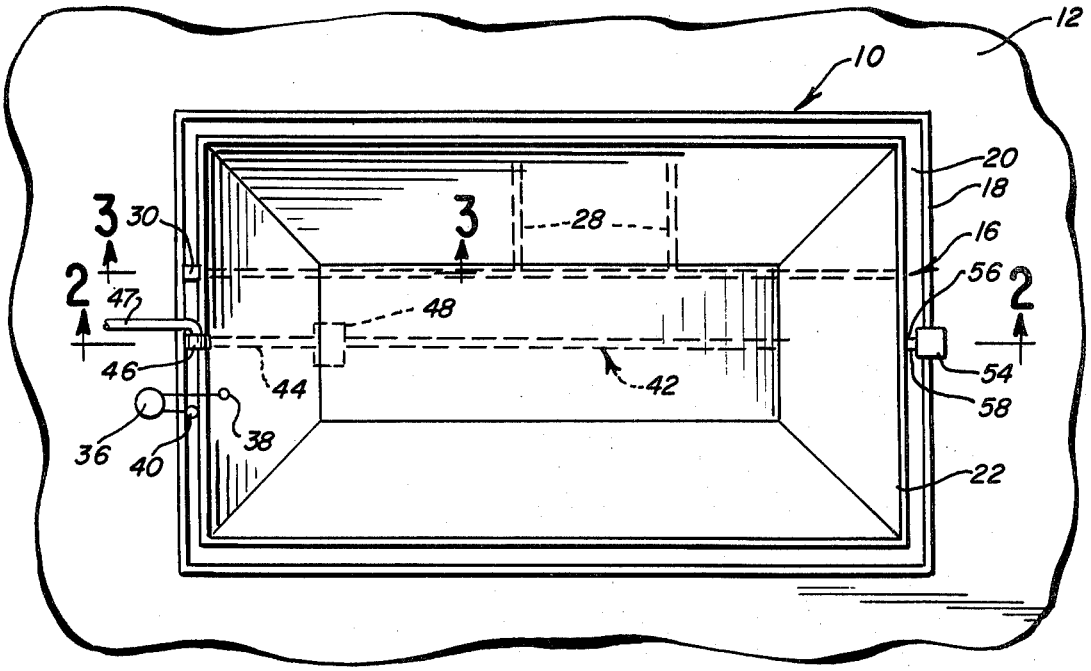
FIG. 1 is a plan view of a lagoon constructed in accordance with the principles of the present invention.
Figure 2:
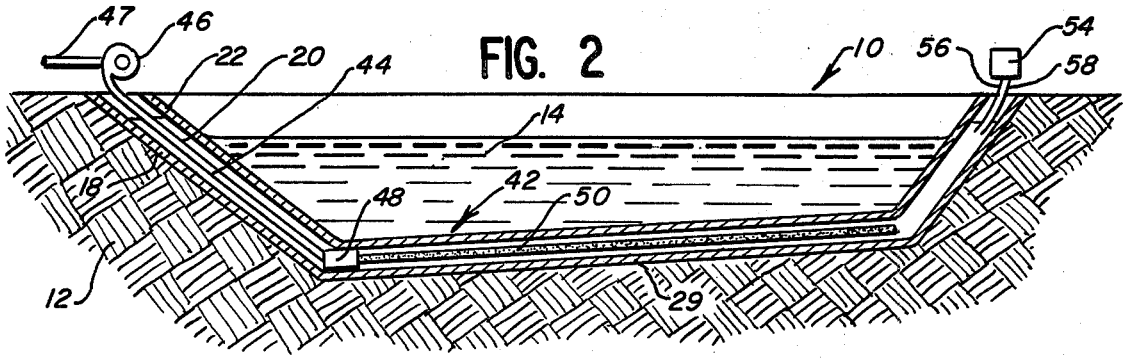
FIG. 2 is an enlarged view taken generally along 2—2 of FIG. 1.
Figure 3:
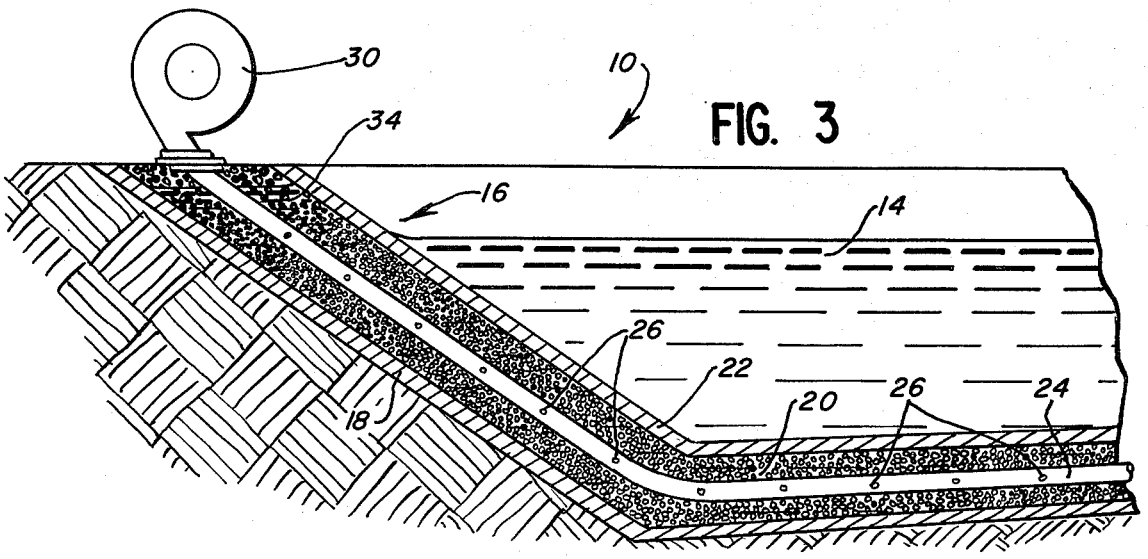
FIG. 3 is an enlarged view taken generally along line 3—3 of FIG. 1.

Referring to the drawings and initially to FIG. 1 there is illustrated a lagoon generally designated by the reference numeral 10 constructured in accordance with the principles of the present invention. The lagoon 10 may be a pit dug out of the earthen soil 12 and is intended to contain water soluble wastes 14 such as domestic sludge, chemicals, and the like, generally in the form of a water solution. It is understood that the present invention is equally applicable to sealing a landfill which normally is used to store solid wastes. Frequently, solid wastes stored in a landfill include hazardous components and precipitation dissolves some of the hazardous materials so that a sealing system may be required to prevent the dissolved hazardous materials from seeping into ground water. The lagoon 10 illustrated in FIG. 1 is depicted as rectangular in shape; however, it should be understood that a plurality of configurations may be employed and the invention is not restricted to a particular configuration of the lagoon 10. Leakage of the water soluble chemicals or liquid waste 14 from the lagoon 10 into the soil 12 is prevented by a composite seal generally designated by the reference numeral 16. As best illustrated in FIG. 3, the composite seal 16 includes a first or outer confining seal 18 that is fabricated by mixing a water expandable colloidal clay, such as bentonite, into the soil 12 at a depth of approximately ¼" to 6". A second layer 20 is placed on top of the outer layer or seal 18 and consists of a granular fill material capable of allowing water to flow therethrough, such as stone or the like. A third layer or inner seal 22 is disposed on top of the granular fill preferably by mixing water expandable colloidal clay, such as bentonite, into the upper surface of the granular fill material 20. Alternatively, the inner seal 22 may be formed by mixing the colloidal clay with a suitable clay supporting material, such as soil, and applying the mixture over the granular fill material 20.

In accordance with an important feature of the present invention, the outer seal layer 18 and the inner seal layer 22 should each contain water swellable colloidal clay in an amount of about 8% to 35% based on the total weight of each seal layer 18 and 22. Below about 8% by weight water swellable colloidal clay, there is insufficient sealing so that leakage will occur. Above about 35% by weight water swellable colloidal clay, there is insufficient support for the clay to keep the clay in its intended location. Preferably, the inner and outer seal layers include water swellable colloidal clay in an amount of about 10% to about 20% based on the total weight of the seal layers 18 or 22.

The colloidal clay utilized in the present invention is water swellable colloidal clay which will hydrate in the presence of water, i.e., will swell in the presence of water. In accordance with one important embodiment of the present invention, the colloidal clay is bentonite. A preferred bentonite is sodium bentonite which is basically a hydratable montmorillonite clay of the type generally found in the Black Hills region of South Dakota and Wyoming. This clay has sodium as its predominant exchange ion. However, the bentonite utilized in accordance with this embodiment of the present invention may also contain other cations such as magnesium and iron. The replaceable or exchangeable cations may be either sodium or calcium. There are cases wherein a montmorillonite predominant in calcium ions can be converted to a high swelling sodium variety through a well known process called "peptizing". The colloidal clay utilized in this invention may be one or more peptized bentonites. The colloidal clay utilized in accordance with the present invention may be any member of the dioctahedral or trioctahedral smectite group or mixtures thereof. Examples are Beidellite, Nontronite, Hectorite and Saponite. The colloidal clay, i.e., bentonite, generally is finely divided as known for use in water barrier panels and the like.

The composite seal 16, defined by the outer seal layer 18, the granular fill layer 20 and the inner seal layer 22, provides a seal that has been used in the prior art by this assignee to prevent seepage of chemical pollutants into surrounding soil. This particular composite seal 16 has been found to be an excellent seal for land fills and the like that are kept dry since in these types of land fills, there is very little driving force tending to force the leachate through the seal 16. In lagoons, however, such as the lagoon 10 wherein water soluble liquid pollutants 14 are contained, there is a driving force experienced particularly against the inner seal 22 that is proportional to the depth of pollutants 14 in the lagoon 10. It has been discovered that in lagoons, such as lagoon 10, the water soluble chemicals 14 can penetrate or leach through the inner seal 22 in a matter of a few weeks and eventually penetrate the outer seal 18 to contaminate ground waters. The time required for leakage varies with the head or depth of the water-soluble pollutants 14, the thickness of the seals 18 and 22 and the coefficient of permeability of the seals 18 and 22. It has been discovered, however, that the penetration of the leachate through the inner seal 22 can be substantially eliminated by creating a back pressure between the inner seal 22 and the outer seal 18 greater than the pressure exerted on the inner seal 22 by the waste water 14. This back pressure can be created by flooding the area between the inner seal and the outer seal 18 with a clean fluid, such as water, at a level above the level of the lagoon 10, thereby maintaining a positive head on the intermediate clean water relative to the pressure exerted on the inner seal 22 by the waste water 14.

The granular fill layer 20 is flooded by disposing a fluid conduit or pipe 24 within the granular fill layer 20. The fluid conduit 24 is slotted or includes a plurality of apertures 26 to distribute water throughout the granular fill layer 20 to a level above the level of the waste water 14. The conduit 24 extends the length of the granular fill layer 20 and may include branches 28 (illustrated schematically in FIG. 1) to ensure that all void space within the fill layer 20 is flooded. The conduit 24 distributes a clean fluid source, such as water or the like throughout the granular fill layer 20 via a pump 30. The pump 30 is operated to fill the granular fill layer 20 to a level such that the head of the water 34 above the waste water 14 creates a positive pressure adjacent to an undersurface of the inner seal 22 greater than the pressure exerted on an inner surface of the inner seal 24 along the entire inner seal 22. Any slight positive head in the granular fill layer 20 greater than the pressure of the waste water is sufficient to reduce leakage of waste water through the inner seal 22. It has been found that a granular fill liquid level equivalent to 2 to 8 inches of water above the level of the waste water 14 in the lagoon 10 provides excellent resistance to leakage of liquid wastes through the inner seal 22.

The granular fill in the layer 20 constitutes a restriction to the flow of clean water from the conduit 24 and its branches 28. Accordingly, the lagoon 10 and particularly the bottom 29 thereof is sloped or inclined at all points so as to assist the flow of the water and ameliorate frictional loses. The size of the granular fill, i.e., stone aggregate, is not critical, but as an example of a suitable aggregate, the stone has a general size in the range of about $\frac{3}{4}$ inch to about 6 inches.

To maintain the desired head or pressure within the granular fill layer 20, a level sensor 36 is provided including a probe 38 in the lagoon 10 to measure the level of the waste water 14 and a probe 40 is included within the granular fill layer 20 to measure the level or head of the fluid in the granular fill layer 20. This sensor 36 may be a bubble type sensor or a similar type sensor and will determine the relative depth or head of the liquid wastes 14 compared to the head of the clean water 34 in the granular fill layer 20 and signal the pump 30 on and off as required to maintain a positive pressure within the granular fill layer 20. A positive pressure in the granular fill layer 20 equivalent to 2 to 8 inches of water above the adjacent lagoon pressure will reduce leakage of waste water 14 through the inner seal 22 and will not be so great as to drive any appreciable amount of clean water upwardly through the inner seal 22.

It is also desirable to continuously check the lagoon 10 and the inner seal 22 for leakage of pollutants 14 through the seal inner 22. This may be accomplished by placing a sample conduit generally designated by the reference numeral 42 within the granular fill layer 20. The conduit 42 includes a pump suction pipe 44 connected to a pump 46. The pump 46 is coupled to a conduit 47 for emptying sample fluid into a tank for recovering the extracted material for testing. Also included is a junction box 48 coupling the suction pipe 44 to a perforated pipe 50. A single sampling conduit 42 may be positioned within the center of the bottom 29 of the lagoon 10. The sides of the lagoon 10 slope to the bottom 29 and the perforated pipe 50 slopes toward the box 48 so that when the pump is energized, sample fluid from a plurality of locations of the granular fill layer 20 is obtained and may be tested later to determine whether any pollutants have seeped into the granular fill layer 20. If pollutants are found, this will indicate that a leak exists and steps can be taken to seal the leak.

Another way of checking the seal 16 for leaks is to provide a sensor 54 with probes 56 and 58 positioned within the granular fill layer 20 that function to detect the conductivity or pH of the fluid within the granular fill layer 20. This allows a user to determine whether chemicals have leaked into the layer 20 by knowing the conductivity of pH of clean fluid used to flood the granular fill layer 20.

What is claimed and sought to be secured by Letters of the United States is:

1. A method for sealing an earthen container to prevent fluid seepage into surrounding soil, comprising:

disposing a layer comprising water expandable colloidal clay onto soil to form an outer seal, disposing a layer of granular fill material on said lower seal, disposing a layer comprising water expandable colloidal clay onto an upper surface of said granular fill material to form an inner seal, and introducing a fluid into said layer of granular fill material, between said upper and lower seals to provide a positive pressure between said upper and lower seals greater than the pressure on an upper surface of said upper seal.

2. The method set forth in claim 1 wherein said water expandable colloidal clay is bentonite.

3. The method set forth in claim 1 further comprising means for sensing the relative levels of fluid in said container and in said layer of granular material.

4. The method set forth in claim 1 further comprising extracting fluid from said layer of granular fill, and sampling the extracted fluid for traces of said fluid in said container.

5. The method set forth in claim 1 wherein said fluid floods said granular fill pressure into said layer of granular fill material.

6. The method of claim 1 wherein said inner and outer seals comprise 8–35% by weight water expandable colloidal clay.

7. A method for storing waste materials in an earthen pit to prevent fluid seepage into ground water, comprising, forming a first seal by disposing a layer comprising water expandable colloidal clay onto the soil of said pit to form an outer seal;

disposing a layer of granular fill material on said outer seal;

disposing a layer comprising water expandable colloidal clay onto an upper surface of said layer of granular fill material to form an inner seal; and flooding said layer of granular fill material with a fluid at a level greater than a level of fluid contacting an inner surface of said inner seal.

8. The method claimed in claim 7 further comprising extracting a portion of said fluid from said granular fill material so that said extracted fluid can be tested to determine leakage through said inner seal.

9. The method claimed in claim 7 further including sensing the level of waste fluid in said pit and in said granular fill layer.

10. The method claimed in claim 7 wherein said water expandable colloidal clay comprises Bentonite.

11. A sealing system for an earthen storage pit for storing waste materials comprising:

a first layer comprising water expandable colloidal clay disposed on the soil of said pit, a second layer comprising granular fill material disposed on said first layer, a third layer comprising water expandable colloidal clay disposed on an upper surface of said second layer, and means for communicating said second layer with a source of fluid for flooding said second layer to a depth greater than a depth of waste fluid above said third layer.

12. The sealing system set forth in claim 11 wherein said water expandable colloidal clay comprises bentonite.

13. The sealing system of claim 11 further comprising means for sampling clean fluid from said second layer for leakage of said waste fluids through said third layer.

14. The sealing system of claim 11 further comprising means for sensing the level of said clean fluid relative to the level of said waste fluid.

15. The sealing system of claim 11 wherein said first and third layers comprise 8–35% by weight water expandable colloidal clay.

* * * * *

UNITED STATES PATENT AND TRADEMARK OFFICE

CERTIFICATE OF CORRECTION

PATENT NO. : 4,439,062

DATED : March 27, 1984

INVENTOR(S) : ROBERT P. KINGSBURY

It is certified that error appears in the above-identified patent and that said Letters Patent are hereby corrected as shown below:

Column 5, line 19 of the patent, "lower" should be --outer--.

Column 5, line 24 of the patent, "lower" should be --outer--, and "upper" should be --inner--.

Column 5, line 25 of the patent, "upper" should be --inner--.

Column 5, line 26 of the patent, "lower" should be --outer--.

Column 5, line 27 of the patent, "upper" should be --inner--.

Signed and Sealed this

*Eighth* Day of *October 1985*

[SEAL]

*Attest:*

*Attesting Officer*

DONALD J. QUIGG

*Commissioner of Patents and Trademarks—Designate*